US010018418B2

(12) United States Patent
Van Geyn et al.

(10) Patent No.: US 10,018,418 B2
(45) Date of Patent: Jul. 10, 2018

(54) MOBILE REMOVABLE HEARTH FOR FURNACE AND TRANSPORTER

(71) Applicants: Alan Van Geyn, Haliburton (CA); Joseph Jason Saliba, Fort Erie (CA)

(72) Inventors: Alan Van Geyn, Haliburton (CA); Joseph Jason Saliba, Fort Erie (CA)

(73) Assignee: Can-Eng Partners Limited, Niagara Falls, Ontario (CA)

( * ) Notice: Subject to any disclaimer, the term of this patent is extended or adjusted under 35 U.S.C. 154(b) by 633 days.

(21) Appl. No.: 14/251,085

(22) Filed: Apr. 11, 2014

(65) Prior Publication Data

US 2015/0192363 A1 Jul. 9, 2015

Related U.S. Application Data

(60) Provisional application No. 61/924,338, filed on Jan. 7, 2014.

(51) Int. Cl.
*F27D 1/18* (2006.01)
*F27D 3/00* (2006.01)
(Continued)

(52) U.S. Cl.
CPC ..... *F27D 3/0024* (2013.01); *C21D 9/0018* (2013.01); *C21D 9/0025* (2013.01);
(Continued)

(58) Field of Classification Search
CPC .. C21D 9/0018; C21D 9/0025; C21D 9/0056; F27B 17/0016; F27B 17/0033; F27M 2002/013; F27D 3/0024
(Continued)

(56) References Cited

U.S. PATENT DOCUMENTS 2,003,450 A * 6/1935 Ladd ..... F27B 9/16 432/241
2,441,371 A * 5/1948 Piper ..... C21D 9/00 432/241
(Continued)

FOREIGN PATENT DOCUMENTS

DE 2512485 10/1975
EP 1490404 11/1977
(Continued)

*Primary Examiner* — Alissa Tompkins
*Assistant Examiner* — Benjamin W Johnson
(74) *Attorney, Agent, or Firm* — Simpson & Simpson, PLLC

(57) ABSTRACT

A mobile removable hearth skid for a furnace and/or cooling chamber including: a base, the base including a top horizontal surface supporting a refractory platform which possesses a perimeter edge including a front perimeter edge, a rear perimeter edge, and at least two side perimeter edges. The rear perimeter edge and the at least two side perimeter edges form a continuous shoulder extending beyond the base perimeter edge. Also disclosed is a furnace and/or cooling chamber including a refractory lining with a continuous ledge at the bottom edges of the refractory linings mounted on the rear wall and the at least two side walls. A gap is formed by the furnace supports between a bottom surface of the ledge and a surface supporting the furnace supports. The shoulder and ledge form a removable refractory seal.

5 Claims, 11 Drawing Sheets

(51) Int. Cl.

| | |
|---|---|
| ***C21D 9/00*** | (2006.01) |
| ***F27B 17/00*** | (2006.01) |
| ***F27D 3/02*** | (2006.01) |
| ***F27D 9/00*** | (2006.01) |

(52) U.S. Cl.
CPC ..... *F27B 17/0016* (2013.01); *F27B 17/0033* (2013.01); *F27D 1/1858* (2013.01); *F27D 1/1866* (2013.01); *F27D 3/022* (2013.01); *F27D 9/00* (2013.01); *F27D 2003/0037* (2013.01)

(58) Field of Classification Search
USPC ..... 432/242, 239, 241, 244, 246, 261
See application file for complete search history.

(56) References Cited

U.S. PATENT DOCUMENTS 3,476,368 A * 11/1969 Saiki ..... F27B 17/0033 431/167
4,240,788 A * 12/1980 Naito ..... F23D 11/106 431/160
4,856,987 A * 8/1989 Yasuda ..... F27B 9/30 432/128
6,267,588 B1 * 7/2001 Querol ..... F27B 9/10 432/121

FOREIGN PATENT DOCUMENTS

EP 0477117 A1 * 3/1992
EP 1146306 10/2001
FR 2323969 4/1977

* cited by examiner

MOBILE REMOVABLE HEARTH FOR FURNACE AND TRANSPORTER

CROSS REFERENCE TO RELATED APPLICATIONS

This patent application claims the benefit under 35 U.S.C. § 119(e) of U.S. Provisional Application No. 61/924,338, filed Jan. 7, 2014, which application is incorporated herein by reference in its entirety.

FIELD OF THE INVENTION

The present disclosure relates to the field of metal castings, specifically to furnaces used to heat treat metal castings, and more specifically, to the movement of metal castings into and out of furnaces.

BACKGROUND OF THE INVENTION

Metal castings are heat treated to allow the components of the casting to diffuse uniformly throughout the casting. The length of time for heat treatment is dependent on the size and shape of the casting, the metal(s) and other additives included in the casting, and as well as other factors. For this reason, facilities with many furnaces will operate them for different heat-treating time periods. Often, castings are transported by rail to and from the furnace. Because of the inflexibility of railroad tracks, it can be difficult to schedule and move castings into and out of furnaces, especially when heat treating times can very. In addition, it becomes difficult to utilize furnaces to full capacity over time when heat treating times vary for different castings.

SUMMARY OF THE INVENTION

According to aspects described and illustrated herein there is provided a base, the base including a top horizontal surface with a base perimeter edge and at least two supports extending from said top horizontal surface; and, a refractory platform supported by the top horizontal surface and having a refractory perimeter edge including a front perimeter edge, a rear perimeter edge, and at least two side perimeter edges. The rear perimeter edge and the at least two side perimeter edges form a continuous shoulder extending beyond the base perimeter edge, the shoulder having a shoulder horizontal surface and a shoulder vertical surface.

According to aspects described and illustrated herein there is provided a furnace and/or cooling chamber comprising: an enclosure having footings, a top, a rear wall, at least two side walls, and a door opposing the rear wall. Each of the top, rear wall, at least two side walls, and the door include an inner surface with a refractory lining mounted on each of the top inner surface, rear inner surface, at least two side wall inner surfaces, and the door inner surface. A ledge is positioned at the bottom edges of the refractory linings mounted on the rear wall and the at least two side walls, such that a gap is formed between the bottom surface of the ledge on each of said refractory linings and a floor or supporting surface by the furnace supports. The furnace also includes a mobile hearth skid that includes: a base, the base including a top horizontal surface with a base perimeter edge and at least two supports extending from the top horizontal surface and a refractory surface supported by the top horizontal surface and having a refractory perimeter edge. The refractory perimeter edge forms a shoulder extending beyond the base perimeter edge. The shoulder contacts the ledge to form a refractory seal.

According to aspects described and illustrated herein there is provided a removable refractory seal for a furnace comprising: a continuous ledge fabricated from refractory material and positioned proximate a bottom edge of the refractory material lining a rear wall and proximate a bottom edge of at least two side walls of a first furnace, the ledge having a first horizontal surface and a first vertical surface; and, a continuous shoulder formed in a rear edge and at least two side edges of a first mobile refractory platform, the shoulder having a second horizontal surface and a second vertical surface. The second horizontal surface is removably placed in contact with and sealed against said first horizontal surface and said second vertical surface is removably contacted with and sealed against said first vertical surface.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF EMBODIMENTS OF THE INVENTION

At the outset, it should be appreciated that like drawing numbers on different drawing views identify identical structural elements of the invention. It also should be appreciated that figure proportions and angles are not always to scale in order to clearly portray the attributes of the present invention.

While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "substantially" is synonymous with terms such as "nearly", "very nearly", "about", "approximately", "around", "bordering on", "close to", "essentially", "in the neighborhood of", "in the vicinity of", etc., and such terms may be used interchangeably as appearing in the specification and claims. It should be appreciated that the term "proximate" is synonymous with terms such as "nearby", "close", "adjacent", "neighboring", "immediate", "adjoining", etc., and such terms may be used interchangeably as appearing in the specification and claims. Although any methods, devices or materials similar or equivalent to those described herein can be used in the practice or testing of the invention, the preferred methods, devices, and materials are now described.

Figure 1:
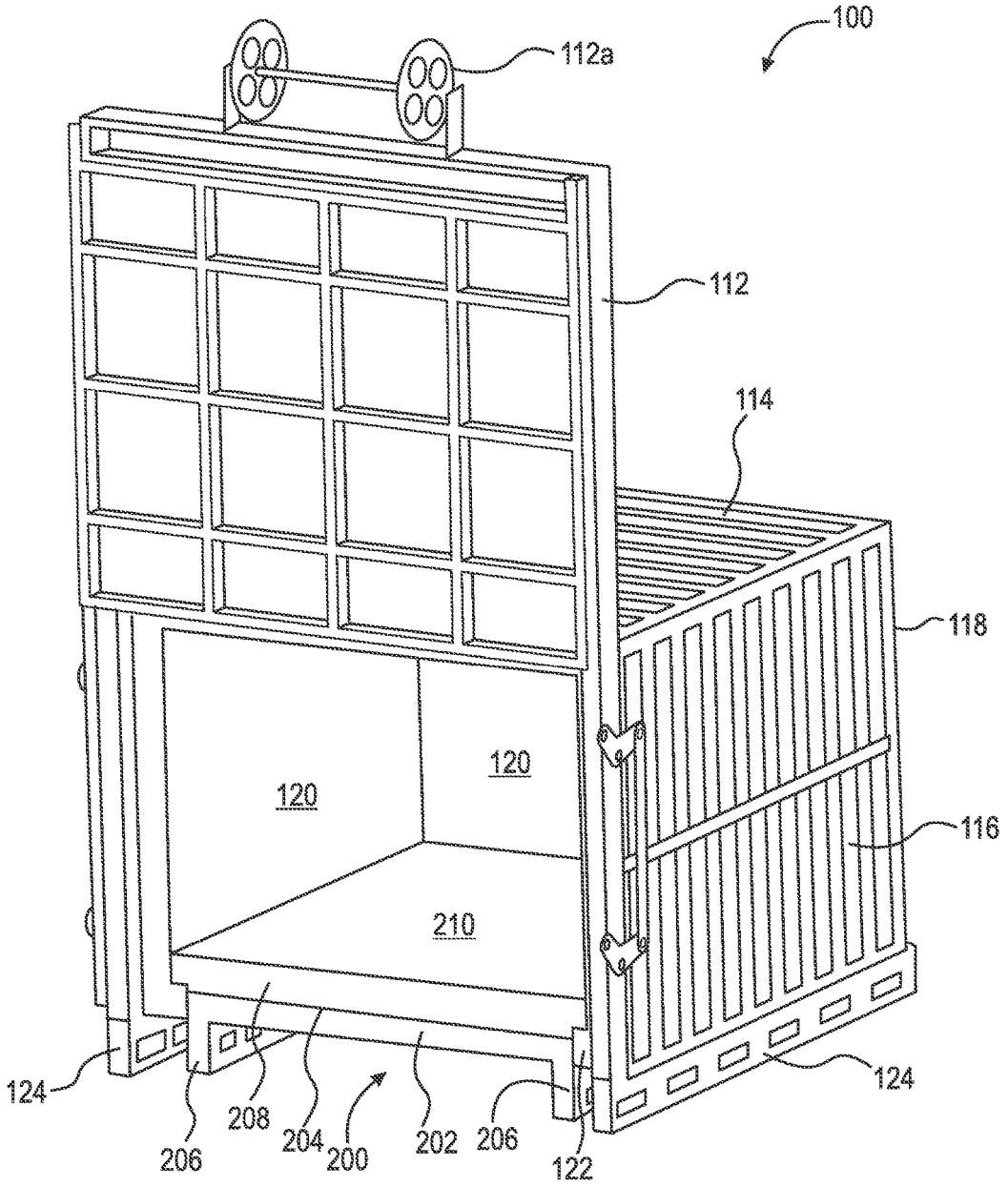
FIG. 1 is a front perspective view of the furnace of the present invention with the door open to reveal the mobile hearth skid positioned inside the furnace.

Adverting to the figures, FIG. 1 is a front perspective view of furnace 100 with door 112 open to reveal mobile hearth skid 200 ("skid 200") positioned inside furnace 100. Door 112 is opened by wheeled hoists 112*a*. Furnace 100 is an enclosure having top 114, side walls 116, and rear wall 118 opposite door 112. It can be seen that the inner surfaces of side walls 116 and rear wall 118 are lined with refractory material 120. In one embodiment, the refractory material lining 120 including ledge 122 is fabricated from firebrick and cast refractory material. Footings 124 extend along the bottom of the two opposing side walls 116 and rear wall 18.

Figure 2:
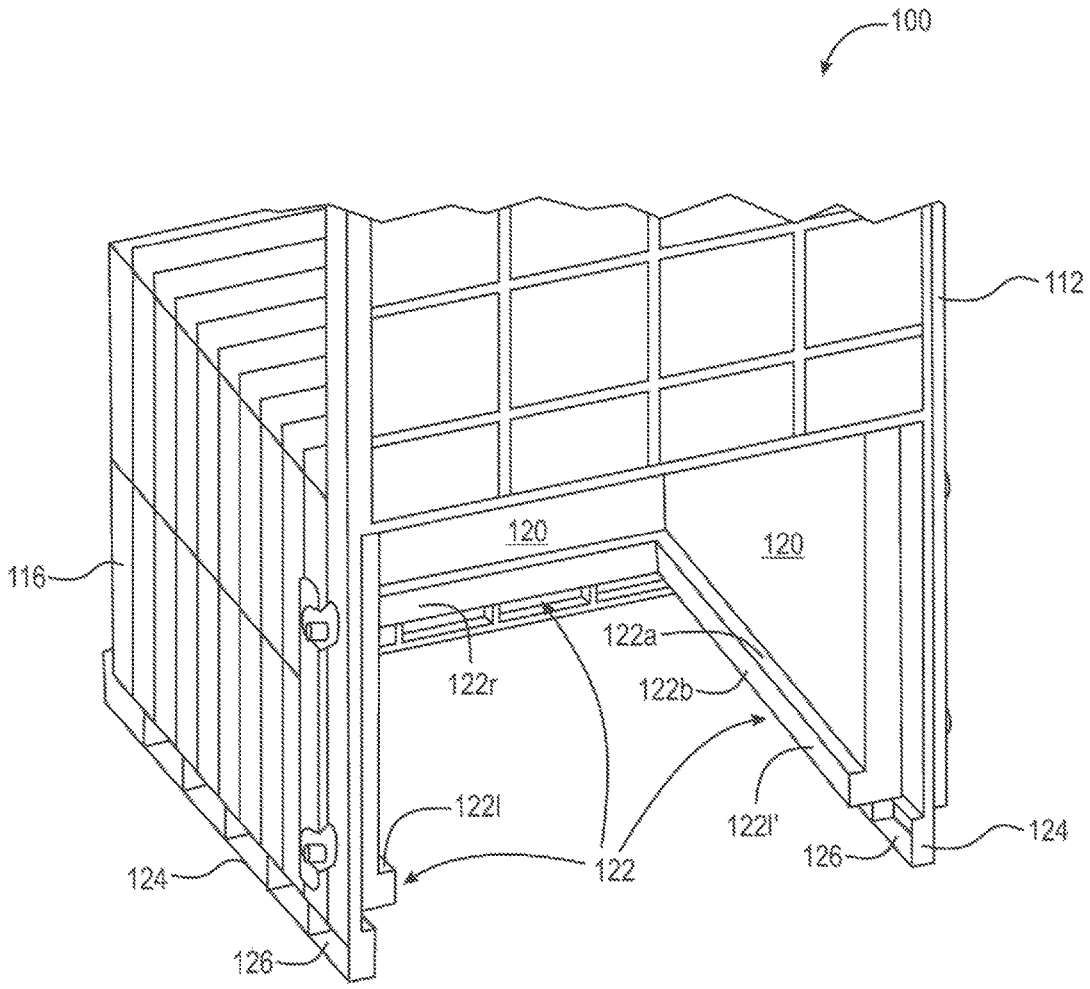
FIG. 2 is a second front perspective view of the furnace with the skid removed.

FIG. 2 is a second front perspective view of furnace 100 with skid 200 removed. Clearly seen is refractory lining 120 mounted on the inner surfaces of side walls 116 and rear wall 118. Also seen is single continuous ledge 122 ("ledge 122") extending the length of side walls 116 and rear wall 118. Ledge 122 includes ledge horizontal surface 122*a* and ledge vertical surface 122*b*. Not seen is a refractory lining mounted on the inner surface of door 112. Continuous ledge 122 includes three portions or sections left lateral section 1221 on the left side of furnace 100, right lateral section 1221' on the right side of furnace 100 and parallel to section 1221, and rear ledge section 122*r* which is perpendicular to and connects lateral ledge sections 1221 and 1221'. It can be seen that footings 124 form a gap 126 between the floor supporting furnace 100 and the bottom surface of ledge 122.

Figure 3:
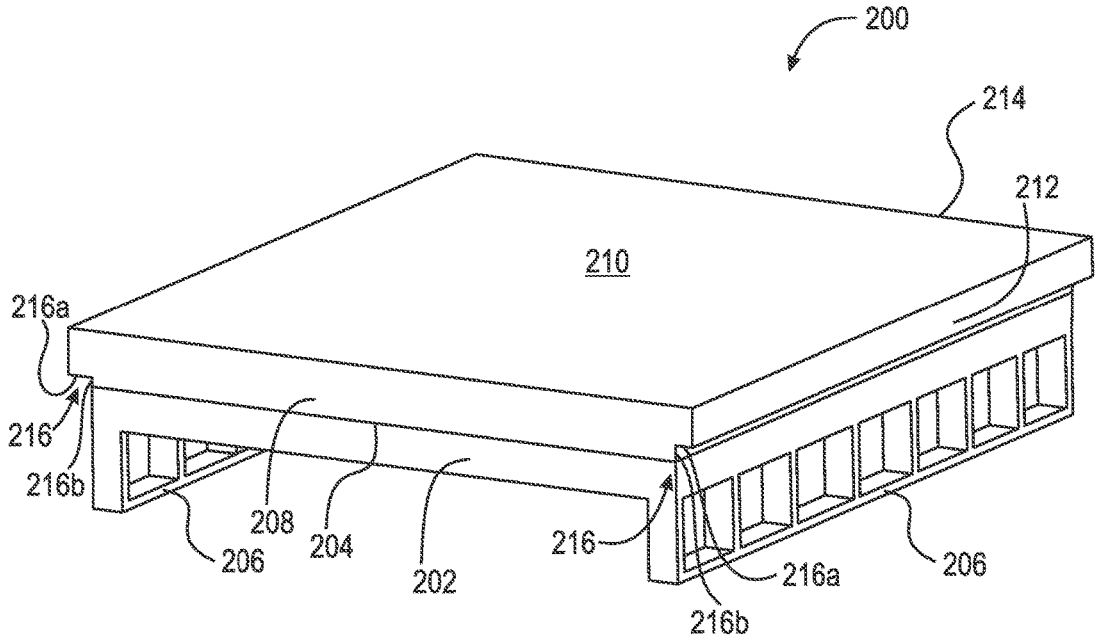
FIG. 3 is a front perspective view of the mobile hearth skid.
Figure 4:
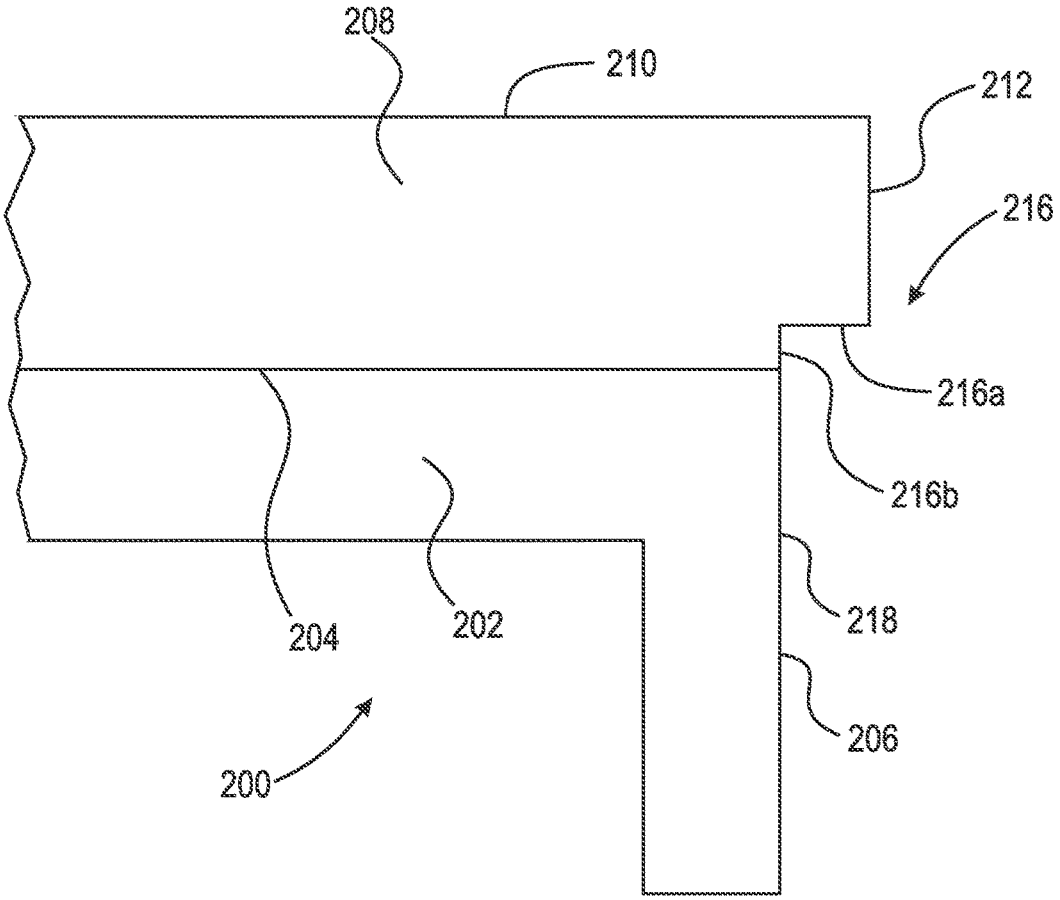
FIG. 4 is a partial front view of the mobile hearth skid showing the position of the perimeter of the base and the shoulder formation of the perimeter edge of the platform.

FIG. 3 is a front perspective view of mobile hearth skid 200. Base 202 includes top surface 204 ("surface 204") (not seen) and base supports 206. In an example embodiment, base 202 is fabricated from reinforced steel. Surface 204 is in the form of a table top extending between supports 206 and in turn bears refractory platform 208 ("platform 208"). Platform 208 includes support surface 210 used to support castings as described below and is fabricated from refractory material. Side edges 212 and rear edge 214 (not shown) are shaped into shoulder 216 with horizontal surface 216*a* and vertical surface 216*b* as seen in FIG. 4. In the embodiment shown, it can be seen that side edges 212 and rear edge 214 are continuous and part of integral platform 208. The word integral in this context means that the component parts are formed together as a single unit. In an example embodiment, shoulder 216 may extend partly along each side edge 212 and/or rear edge 214. In an example embodiment, shoulder 216 may extend continuously along each side edge 212 and/or rear edge 214 as seen in FIG. 3.

FIG. 4 is a partial front view of refractory platform 208 showing shoulder 216 of one side edge 212. Horizontal surface 216*a* and vertical surface 216*b* are shown with surface 216*a* extending beyond perimeter edge 218 of mobile hearth skid 200. Preferably, vertical surface 216*b* is flush or even with the perimeter edge 218 of skid 200 as shown in FIG. 4.

Figure 5:
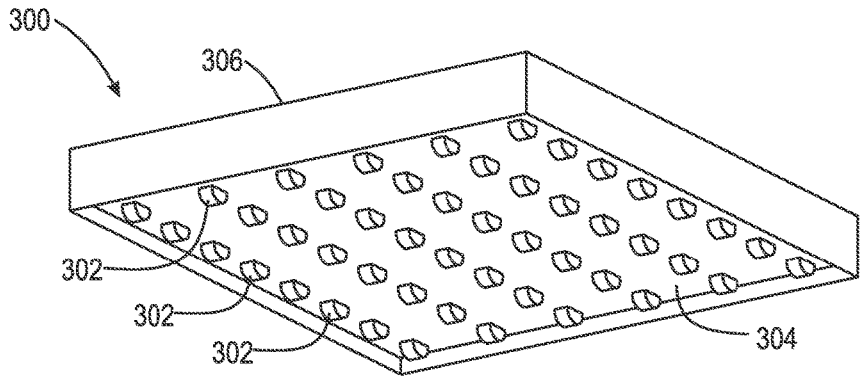
FIG. 5 is a bottom perspective view of the transporter depicting a plurality of rolling means attached to or extending from the bottom surface of the transporter.

FIG. 5 is a bottom perspective view of transporter 300 depicting a plurality of rolling means 302 attached to or extending from bottom surface 304. In an example embodiment, rolling means 302 are casters or wheels swiveling attached to transporter 300 to enable transporter 300 to move efficiently and smoothly in any direction. In an example embodiment, rolling means 302 are constructed so as to raise or lower transporter 300. Transporter surface 306 can be used to carry mobile hearth skid 200 with or without refractory platform 208. In a preferred embodiment transporter 300 is programmable, i.e., it is equipped with a programmable logic controller. Suitable transporters are manufactured by Italcarrelli Srl, Via Monte Rosa, 9-36072, Chiampo (VI) Italy.

Figure 6A:
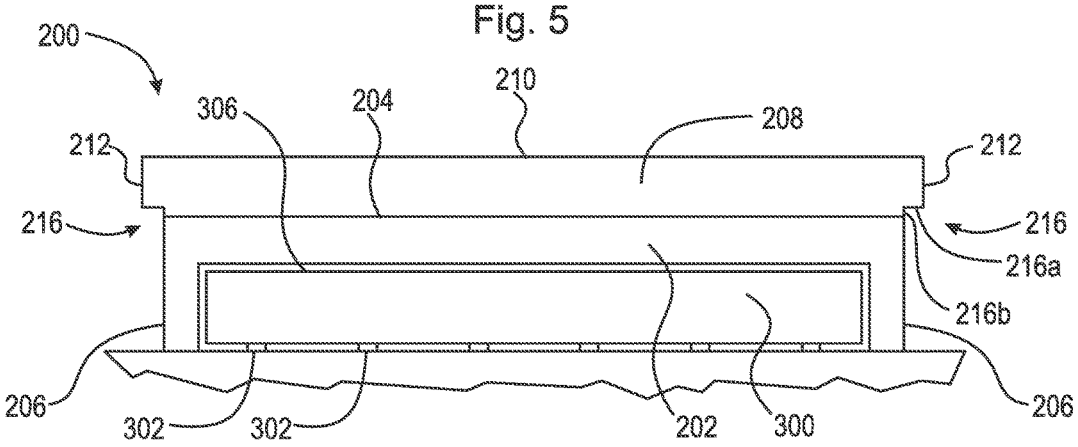
FIG. 6A is a front view of the transporter positioned between the supports of the mobile hearth skid.
Figure 6B:
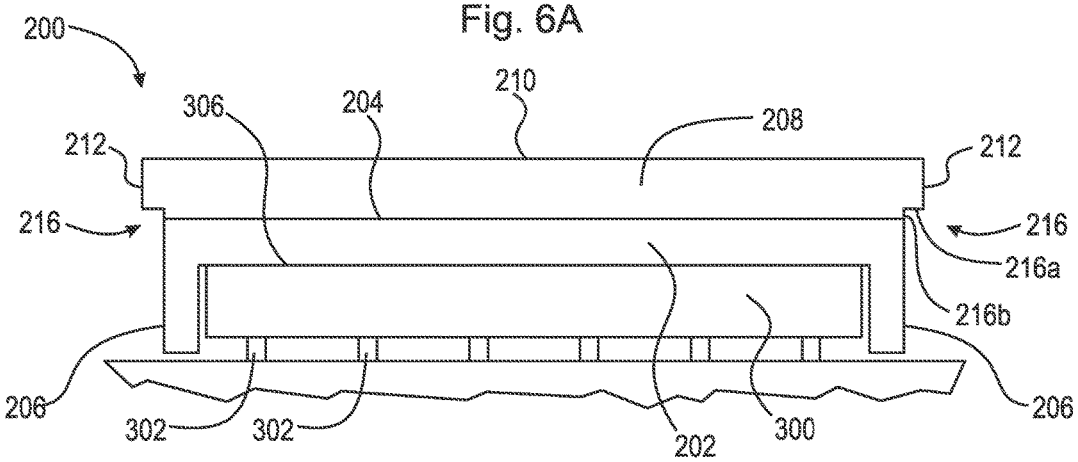
FIG. 6B is the same view as FIG. 6A showing the rolling means raised or extended so that the mobile hearth skid is lifted raising the base supports off the floor or ground and enabling the transporter to move or transfer the skid.

FIG. 6A is a front view of transporter 300 positioned between supports 206 of mobile hearth skid 200. Rolling means 302 are seen in a lowered or nonextended position such that a gap is present between transporter surface 306 and base 202. FIG. 6B is the same view showing rolling means 302 raised or extended so that skid 200 is lifted raising supports 206 off the floor or ground and enabling transporter 300 to move or transport skid 200. Such movement may be performed with or without castings supported on refractory surface 210.

Figure 7:
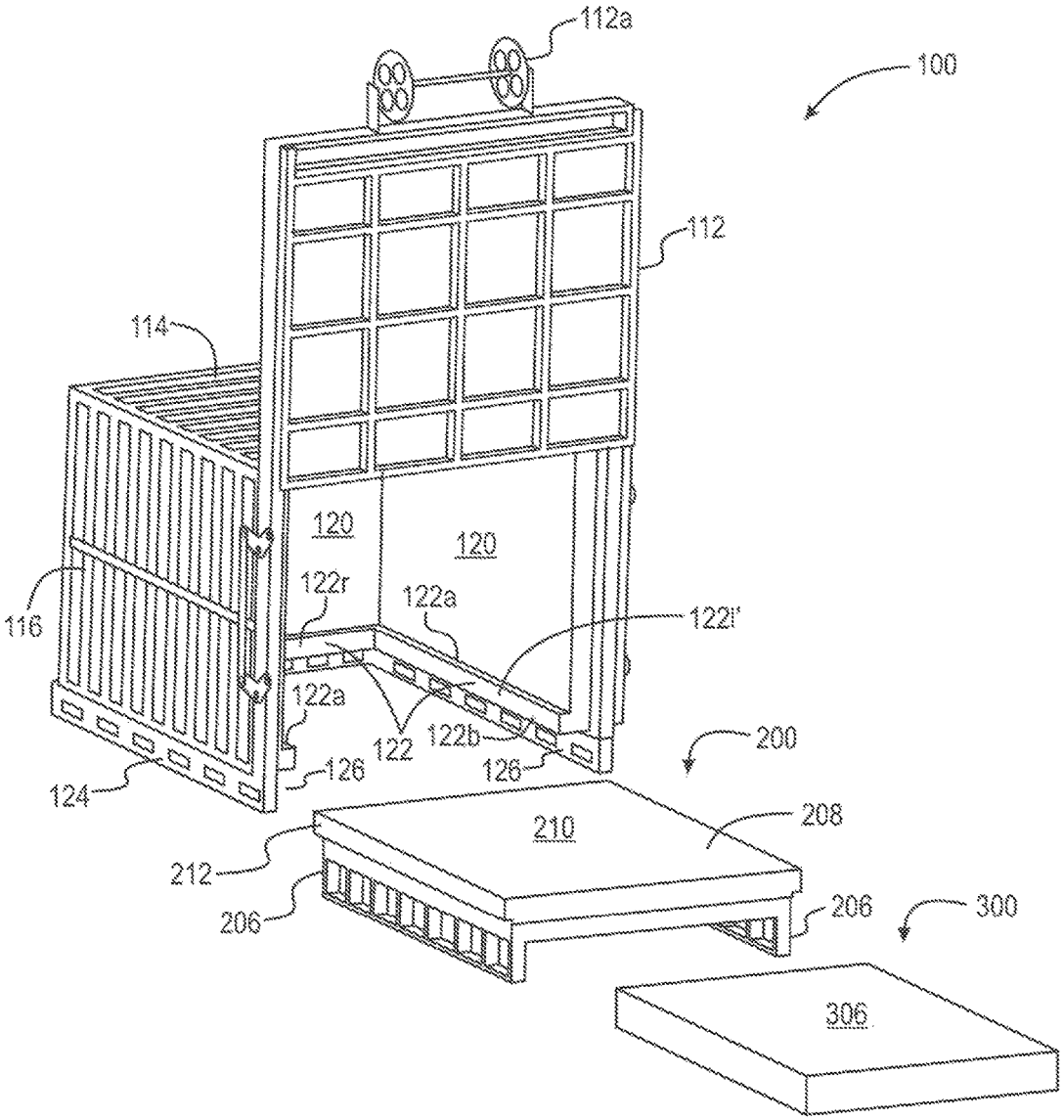
FIG. 7 is a front perspective view of the combination of the furnace, mobile hearth skid, and transporter of the present invention.

FIG. 7 is a front perspective view of the combination of furnace 100, mobile hearth skid 200, and transporter 300. Transporter 300 is moved or is programmed to move between supports 206 of base 200. Subsequently, transporter 300 carries skid 200 into furnace 100 with door 112 closing after skid 200 is lowered onto ledge 122 of refractory material 120.

Figure 8A:
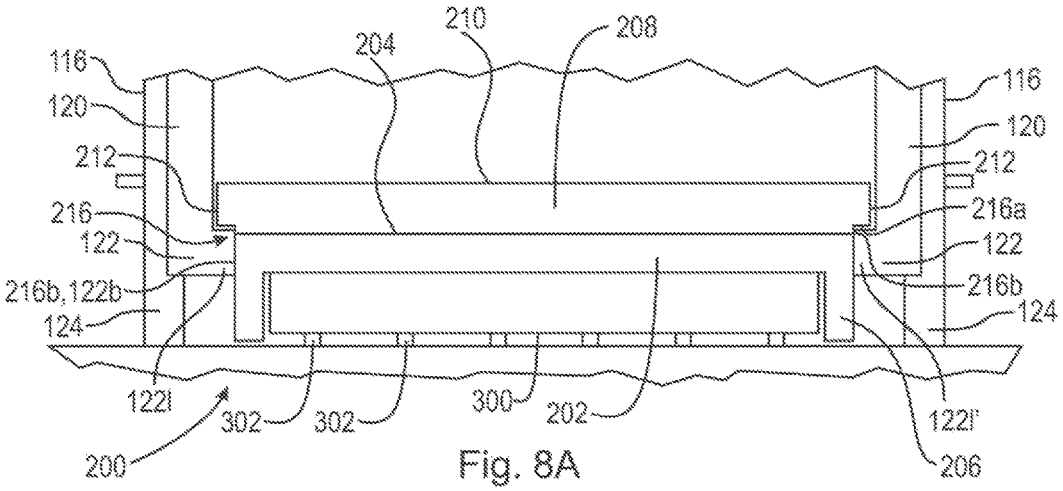
FIG. 8A is a front view of the skid after it is carried into the furnace and/or cooling chamber with rolling means extended.
Figure 8B:
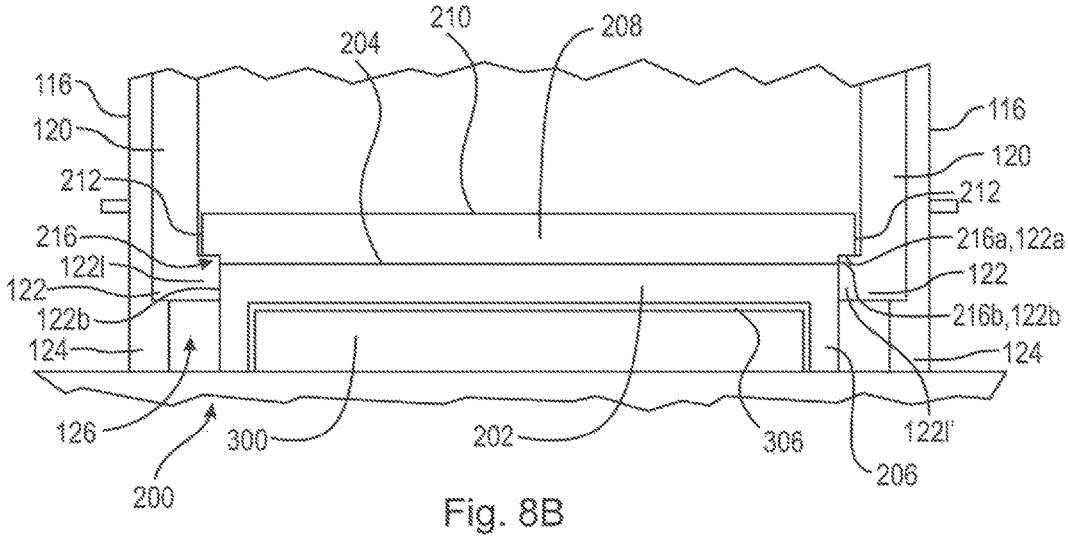
FIG. 8B is the same front view showing the rolling means retracted to form a refractory seal.

FIG. 8A is a front view of skid 200 after it is carried into furnace 100 by transporter 300. Rolling means 302 are seen extended and holding refractory platform 208 so that shoulder 216 is lifted above lateral sections 1221 and 1221' of continuous ledge 122. Although not seen in FIG. 8A, shoulder 216 is also lifted above rear section 122*r* of continuous ledge 122. FIG. 8B is the same front view showing rolling means 302 retracted thereby lowering skid 200 and placing shoulder lateral surface 216*a* of shoulder 216 on horizontal surface 122*a* of each of sections 1221, 122*r*, and 1221' of ledge 122 while shoulder vertical surface 216*b* contacts the ledge vertical surface 122*b* of each of sections 1221, 122*r*, and 1221' to form a refractory seal to reduce or prevent the escape of heat from furnace 100 during the heat treatment of castings C supported by refractory platform surface 306.

Figure 9A:
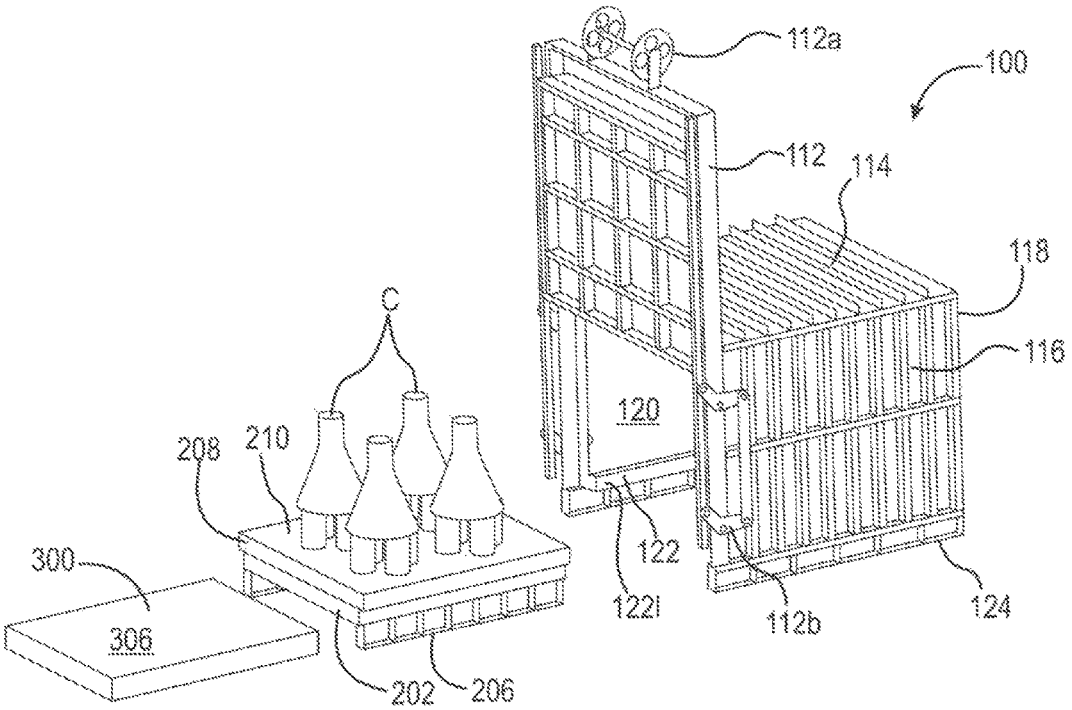
FIGS. 9A-9E are front perspective views showing a single transporter loading and withdrawing castings supported by a mobile hearth skid from a furnace.
Figure 9B:
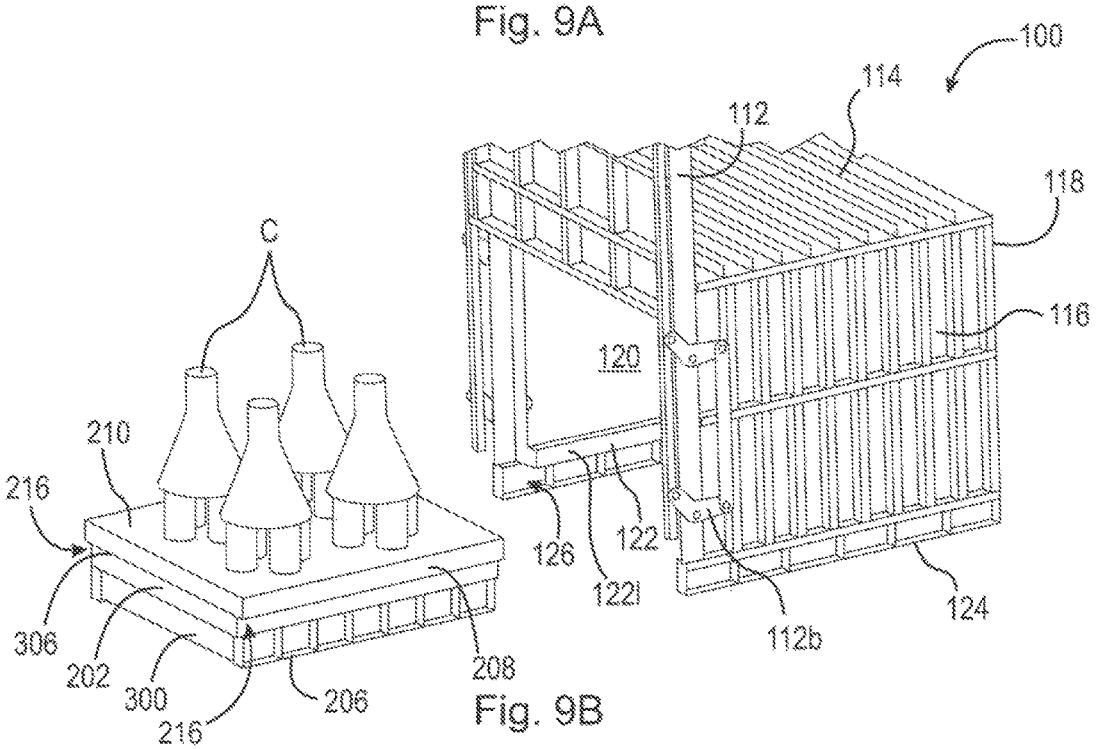

FIGS. 9A-9E are front perspective views showing a single transporter 300 loading castings C and withdrawing castings C from a furnace 100. FIG. 9A is similar to FIG. 7 showing transporter 300 positioned to move between supports 206 of base 202 of mobile hearth skid 200. Castings C are seen resting on top surface 210 of refractory platform 208. Door 112 is open. It can be seen that furnace 100 includes refractory lining 120 with ledge 122. FIG. 9B shows transporter 300 lifting skid 200 including castings C and moving skid 200 toward furnace 100.

Figure 9C:
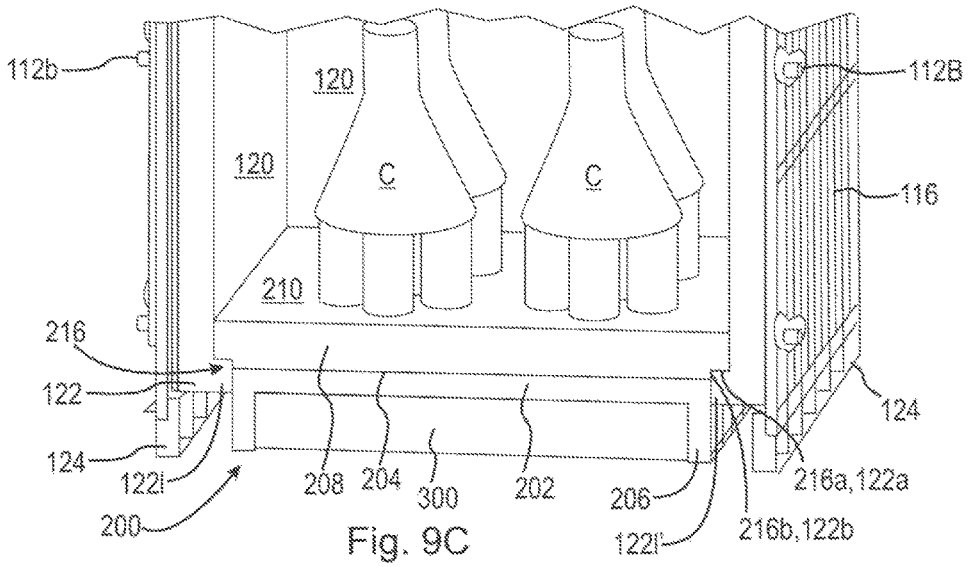
Figure 9D:
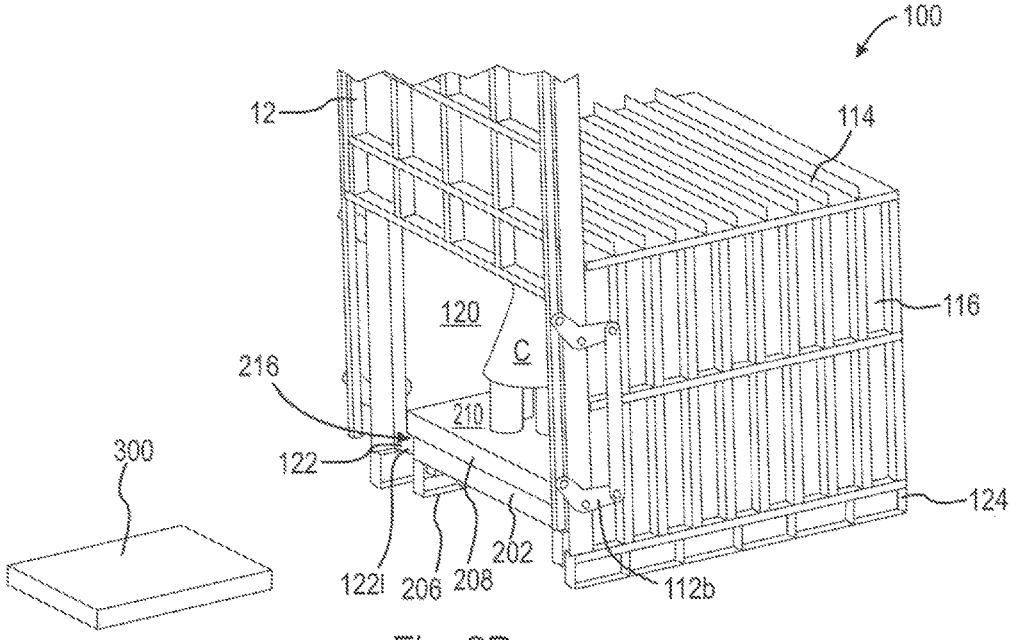
Figure 9E:
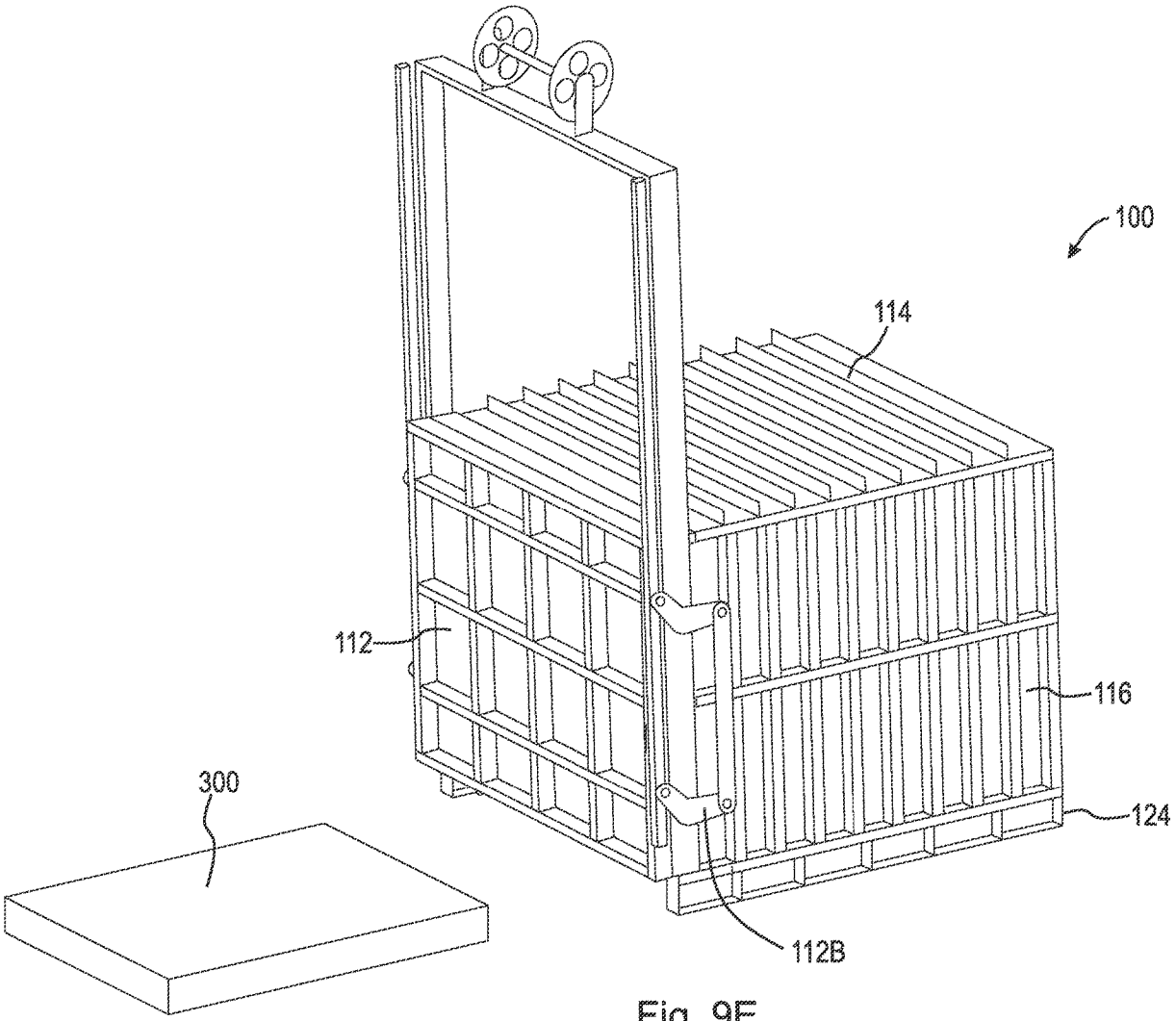

FIG. 9C depicts castings C supported by platform 208 with rolling means 302 (not shown) refracted so as to lower skid 200 with platform 208 onto ledge 122. It can be seen that the refractory seal is formed by the contacting and sealing of shoulder horizontal surface 216*a* and shoulder vertical surface 216*b* with ledge horizontal surface 122*a* and ledge vertical surface 122*b*, respectively. Finally, FIG. 9D shows transporter 300 withdrawn from furnace 100 after which door 112 is lowered and drawn by hinges 112*b* into contact with platform 208 to complete the refractory seal as seen in FIG. 9E. Preferably, skid 200 is sized and shaped in conjunction with ledge 122 and gap 126 so the weight of platform 208 (and castings C, if applicable) is supported by platform supports 206 to prevent the weight of skid 200 and castings C from being supported by ledge 122.

Figure 10:
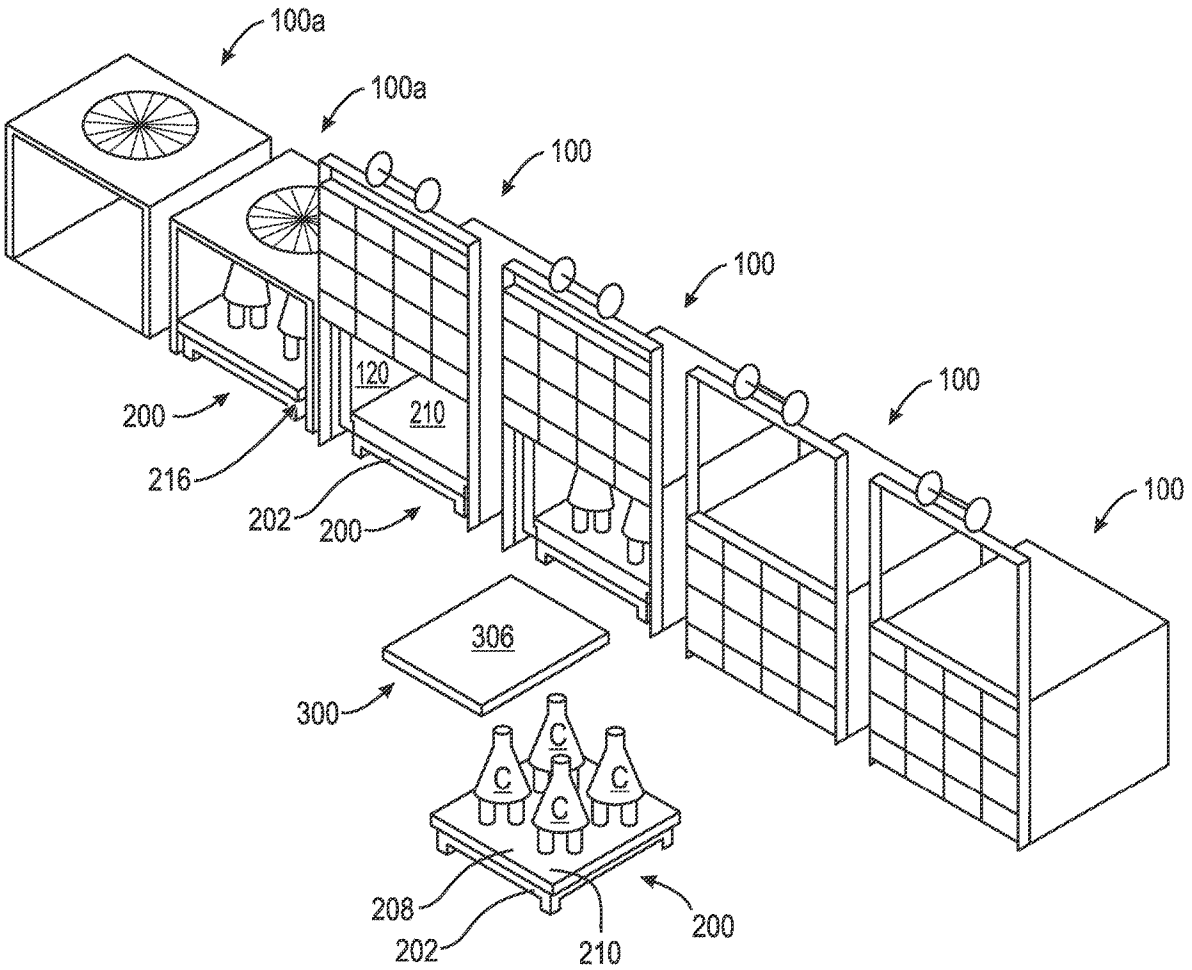
FIG. 10 is top perspective schematic view of an assembly of furnaces being loaded and unloaded by a single transporter.

FIG. 10 is top perspective schematic view of a plurality of furnaces 100 and cooling chambers 100*a* (collectively "chambers") being loaded and unloaded by a single transporter 300. Because curing cycles for castings are often long it is possible for a single transporter 300 to load and unload several furnaces 100 and/or cooling chambers 100*a*. If transporter 300 is programmable, only a solid floor and guidance system will be required to enable a single transporter 300 to be used with multiple furnaces 100 and/or cooling chambers 100*a*. In an example embodiment, more than one transporter 300 may be used to load and unload a plurality of furnaces. The programming can include instructions as to when to load or unload furnaces 100/chambers 100*a* as well as movement and alignment instructions.

Thus it is seen that the objects of the invention are efficiently obtained. Although changes and modifications to the invention should be readily apparent to those having ordinary skill in the art, which changes would not depart from the spirit and scope of the invention as claimed.

What is claimed is:

1. An assembly comprising:

at least one mobile hearth skid comprising:

a base comprising a top horizontal surface with a base perimeter edge and at least two supports extending from said top horizontal surface; and, a refractory platform supported by said top horizontal surface and comprising a refractory platform perimeter edge including a front perimeter edge, a rear perimeter edge, and at least two side perimeter edges;

wherein said rear perimeter edge and said at least two side perimeter edges form a continuous shoulder extending beyond said base perimeter edge, said shoulder having a shoulder horizontal surface and a shoulder vertical surface;

wherein the assembly further comprises: a plurality of furnaces and/or cooling chambers, wherein each of said plurality of furnaces and/or cooling chambers comprises:

an enclosure comprising footings, a top, a rear wall, at least two side walls, and a door opposing said rear wall, wherein each of said top, first and second side walls, said rear wall, and said door comprise an inner surface;

a refractory lining attached to each of said top inner surface, said first and second side wall inner surfaces, said rear wall inner surface, and said door inner surface;

a single continuous ledge comprising first, second and third ledge sections, said first ledge section positioned at a bottom edge of said refractory lining attached to said first side wall inner surface, said second ledge section positioned at a bottom edge of said refractory lining attached to said second side wall inner surface and said third ledge section positioned at a bottom edge of said refractory lining attached to said rear wall inner surface, wherein each of said first, second and third ledge sections of said single continuous ledge has a ledge vertical surface and a ledge horizontal surface; and wherein the assembly further comprises: a mobile transporter positioned under said top horizontal surface of one of said at least one mobile hearth skid;

wherein said third ledge section is continuous with and perpendicular to each of said first and second ledge sections;

wherein a gap is formed by said footings between a bottom surface of said single continuous ledge and a surface supporting said footings;

wherein said shoulder vertical surface and said shoulder horizontal surface are arranged to contact said ledge vertical surface and said ledge horizontal surface, respectively, of each of the first, second and third ledges sections to form a refractory seal; and wherein the mobile transporter is removable from below the at least one mobile hearth skid after formation of the refractory seal.

2. The assembly as recited in claim 1 wherein said mobile transporter is programmable.

3. The assembly as recited in claim 1 wherein said mobile transporter comprises a plurality of extendable rolling means.

4. The assembly as recited in claim 1 further comprising a plurality of mobile transporters, each of the plurality of mobile transporters independently positionable under said top horizontal surface of one of said at least one mobile hearth skid.

5. The assembly as recited in claim 1 wherein the at least one mobile hearth skid is removable from the plurality of furnaces and/or cooling chambers in the absence of formation of the refractory seal.

* * * * *